US005842794A

United States Patent [19]

Zimmermann

[11] Patent Number: 5,842,794

[45] Date of Patent: Dec. 1, 1998

[54] PERFORATING DEVICE AND PROCESS FOR SETTING PERFORATING DEVICES

[75] Inventor: Thomas Zimmermann, Berlin, Germany

[73] Assignee: F. Zimmermann GmbH & Co. KG, Berlin, Germany

[21] Appl. No.: 918,942

[22] Filed: Aug. 25, 1997

[30] Foreign Application Priority Data

Aug. 28, 1996 [DE] Germany ..... 196 36 242.3

[51] Int. Cl.[6] ..... B41J 3/24

[52] U.S. Cl. ..... 400/138.1; 400/138.2; 101/91; 101/19; 83/30

[58] Field of Search ..... 400/135, 138.1, 400/138.2; 101/91, 92, 93.24, 19; 83/30, 425.2, 505, 508.1

[56] References Cited

U.S. PATENT DOCUMENTS

| | | | |
|---|---|---|---|
| 1,795,564 | 3/1931 | Korge | 400/138.1 |
| 3,295,438 | 1/1967 | Webb et al. . | |
| 3,469,777 | 9/1969 | Anderson et al. | 101/91 |
| 3,565,334 | 2/1971 | Reynolds | 101/93.24 |
| 4,367,676 | 1/1983 | Clark . | |
| 4,723,486 | 2/1988 | Le Meur et al. | 101/91 |
| 4,884,906 | 12/1989 | Yamaguchi | 101/93.24 |
| 5,493,967 | 2/1996 | Malin et al. | 101/91 |
| 5,570,633 | 11/1996 | Schultz et al. | 101/247 |
| 5,657,692 | 8/1997 | Theriault | 101/132 |
| 5,719,381 | 2/1998 | Flückiger et al. | 101/91 |

FOREIGN PATENT DOCUMENTS

| | | |
|---|---|---|
| 25 20 575 A1 | 11/1976 | Germany . |
| 37 14 567 C2 | 11/1987 | Germany . |
| 37 14 567 C2 | 8/1989 | Germany . |
| 195 12 377 A1 | 10/1996 | Germany . |
| 196 36 242 C1 | 2/1998 | Germany . |
| 288240 | 6/1964 | Netherlands . |
| 928428 | 6/1963 | United Kingdom . |

OTHER PUBLICATIONS

Dipl.–Ing. Peter Blomeyer, Dipl.–Ing. Meng–Kiat Jeoh 1976 *Schrittmotorsteuerun g mit Fernsteuereingängen* Elektronik 1976 Heit 10 pp. 381–385.

F. Zimmermann GmbH & Co. KG *Perfosotar* Pernuma.

*Primary Examiner*—Eugene H. Eickholt

*Attorney, Agent, or Firm*—McGlew and Tuttle

[57] ABSTRACT

A perforating device for the representation of letters and numbers with adjustable perforating gearwork and with a drive for the perforating gears for rapid shifting of letters and numbers and to a process for setting perforating devices. The perforating device provides for the representation of letters and numbers. The device is constructed compactly and assures a simple manipulation and an exact setting of the letters and numbers, as well as an uncomplicated electronic control. Drives for perforating gears are arranged in recesses arranged on the periphery of perforating gear uptake.

13 Claims, 7 Drawing Sheets

PERFORATING DEVICE AND PROCESS FOR SETTING PERFORATING DEVICES

FIELD OF THE INVENTION

The invention concerns a perforating device for the representation of letters, symbols, and numbers with an adjustable gearwork, and a process for the setting of perforating devices.

BACKGROUND OF THE INVENTION

The setting of perforating gearworks of perforating machines is accomplished manually according to the general state of the art by means of a lever mechanism (pamphlet of the company F. Zimmermann GmbH and Co. KG "PERFOSTAR).

The numbers, letters and symbols to be perforated are set with rigidly attached adjusting levers or with removable guide pins.

Setting by hand by means of mechanical lock-in positions is expensive and frequently leads to erroneous settings, which is a particularly great disadvantage in the case of official documents.

Externally toothed perforating gears are known, which are driven by hand by means of intermediate gears. It is particularly disadvantageous here that toothed gears that are introduced externally can be easily contaminated and this may lead to disruptions and failures.

In the case of perforating devices with their manual drive types, which have become known, it is disadvantageous that a large structural volume is required and that long power transmission paths arise. The manipulation of perforating devices or the setting of perforating gears is often troublesome and time-consuming. Lever and toothed-gear mechanisms are sensitive to contamination and the disruptions resulting therefrom.

SUMMARY AND OBJECTS OF THE INVENTION

It is an object of the invention to develop a perforating device for the representation of letters, symbols, and numbers, which is constructed in compact manner and which assures a simple and reliable manipulation and an exact setting of the letters, symbols and numbers, as well as an uncomplicated electronic control, and also wherein no special requirements need to be fulfilled for its installation. Further, it is an object of the invention to develop a process for the setting of perforating devices, which assures a simple, reliable, as well as rapid and exact setting of the letters, symbols and/or numbers.

In order to solve this task, the invention provides that electronically controlled drives are provided for the shifting of the perforating gears, whereby the drives for the perforating gears are arranged in recesses of the perforating gear uptake lying on the inside, and these recesses are distributed in a preferably radial and axis-parallel manner over the periphery of the perforating gear uptake. The individual perforating gears of the adjustable gearwork are controlled by means of electronically controlled drives for the shifting of the perforating gears and brought to the programmed position in order to execute the perforation at a predetermined time point.

In comparison to previous gear uptakes for perforating gears, an essentially more compact construction is achieved, which makes it possible to produce electronically controlled or adjustable number, symbol, and letter perforating machines, which do not require more space than previous machines, despite the additional electronic control.

A nearly unlimited number of perforating gears can be arranged next to one another, so that texts and number combinations can be represented.

Short power transmission paths and a simple manipulation as well as a reliable control are achieved with the preferred construction of the invention, in which the drives are arranged in the perforating gear uptake lying inside.

Since the drives operate from the inside, they are extensively protected against contamination and against disturbances due to foreign objects.

According to another preferred form of embodiment of the invention, each of the perforating gears is provided with a toothed drive gear, which is joined by means of a sliding clutch with the axle of a common drive motor, by means of which the predetermined working position is set.

This-form of embodiment is particularly compact and cost-favorable, since only one drive is required for a nearly random number of perforating gears. Also, the control of the perforating gears can be executed in a cost-favorable- manner.

According to one form of embodiment of the invention, each of the perforating gears is set by means of an adjusting disk that can be shifted by motor, whereby an inside toothed gearing of the respective perforating gear engages in the teeth of an intermediate gear, which cooperates with a toothed drive gear. Joining to the adjusting disk and to its drive is produced by means of a hollow axle.

According to another form of embodiment of the invention the electronically controlled drives are arranged on the outside and joined by means of a toothed gear with perforating gears provided with an outer toothed gearing.

The perforating device is suitable both for the perforating of fabric lengths or of page (text) matter as well as copy sets, forms, questionnaires, priority documents, documents of all types. All types of material, paper and plastic foils can be reliably and effectively perforated.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
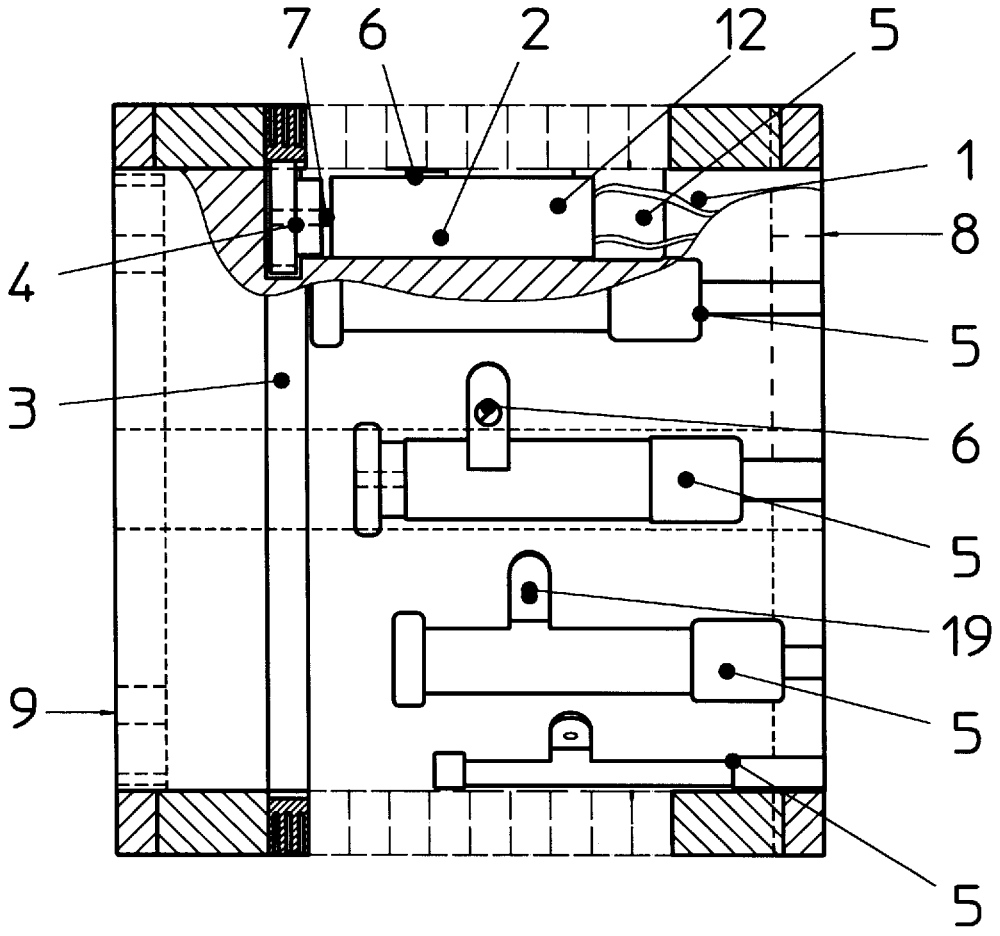
FIG. 1 is a schematic sectional representation of the perforating device.

Referring to the drawings in particular, FIG. 1 shows in a schematic sectional representation the perforating gear uptake 1 for uptake of 10 perforating gears 3, each with the respective shift drive 2.

Perforating gear uptake 1 is designed as a cylindrical unit comprised of aluminum in the example, in which are introduced recesses 5 for uptake of shift drives 2.

Figure 2:
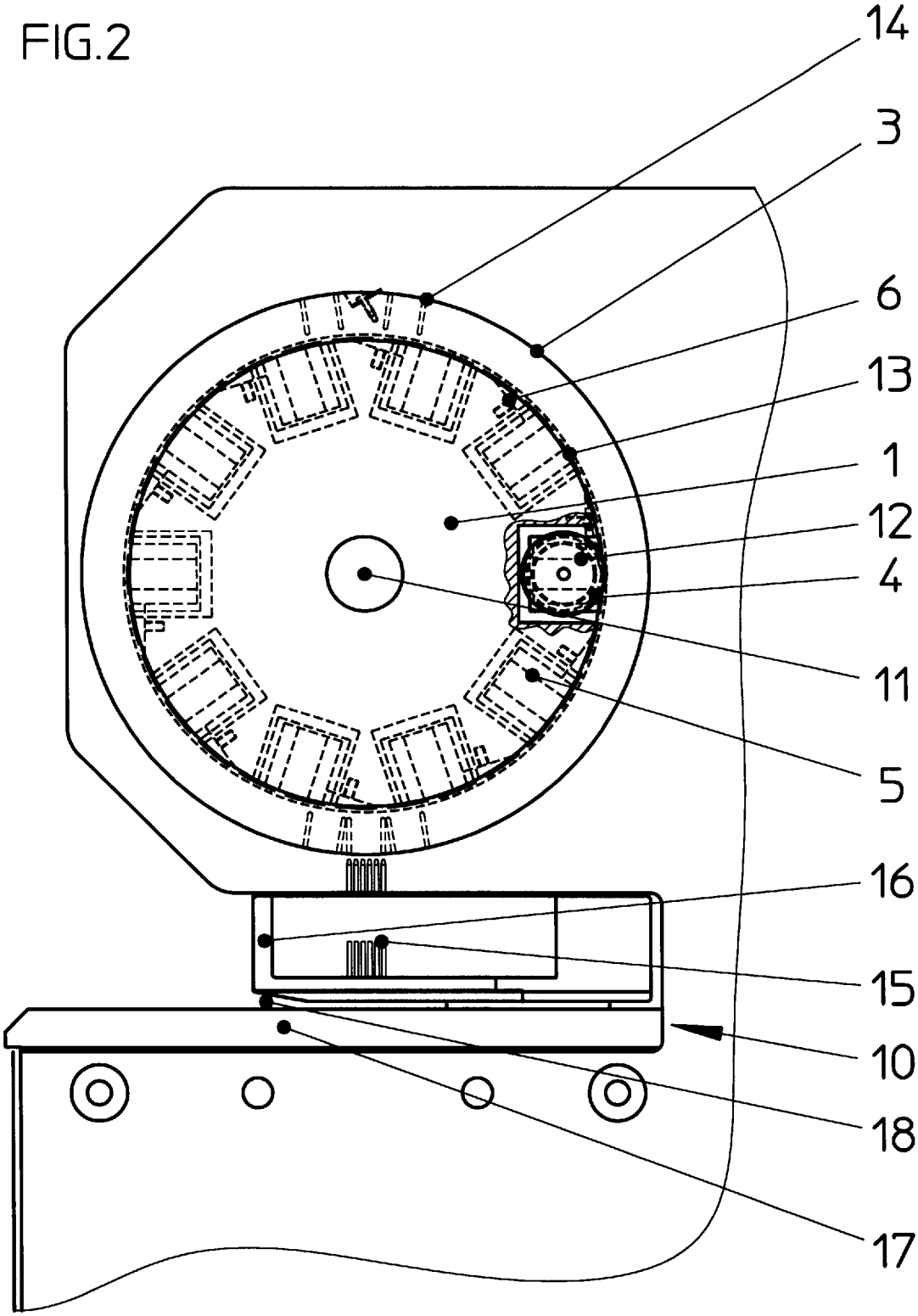
FIG. 2 is a schematic side view of the perforating device including the cutting tool.

Each shift drive 2 is comprised of a motor 12 (FIG. 2) with drive and of a toothed drive gear 4 on motor axle 7. Each shift drive 2 operates with an incremental transmitter (not shown) for positioning the respective perforating gear 3. An inner toothed gearing 13 of the respective perforating gear 3 engages in the respective toothed drive gear 4 on motor axle 7 after the automatic positioning of perforating gear 3 by means of the Incremental transmitter (FIG. 2).

Shift drives 2 are arranged in recesses 5 formed as motor uptakes and locked by a retaining bracket 6 in motor uptake 5. Shift drives 2 are formed by adjusting motors. Retaining bracket 6 is inserted in recessed position in a recess 19 of perforating gear uptake 1.

Motor uptakes 5 are formed distributed around the axle periphery and are radial and parallel to axle 11 of perforating gear uptake 1 (FIG. 2) and are arranged so that they are axially displaced by one gear width d relative to one another. Motor uptakes 5 are interleaved on alternating sides for optimal utilization of the axle periphery. In the example, five motor uptakes 5 are formed on one half of the periphery of perforating gear uptake 1 beginning from the right front side 8 and five motor uptakes 5 are formed on the other half of the periphery of perforating gear uptake 1 beginning from the left front side 9 of perforating gear uptake 1.

Perforating gear uptake 1 forms a gear axis for perforating gears 3.

It is possible to arrange a nearly unlimited number of perforating gears 3 next to one another by the formation according to the invention of motor uptakes 5 in perforating gear uptake 1. In this way it is also possible to arrange in an advantageous manner letters, symbols, or numbers lying next to one another. The serial arrangement of a number of perforating gears 3 makes it possible to represent texts and numerical combinations.

FIG. 2 shows the schematic side view of the perforating device including a cutting tool 10.

It can be seen from FIG. 2 that the perforating device 1 is cylindrical and has axle 11, by means of which a drive (not shown) is activated, which moves perforating gear uptake 1.

Perforating gears 3 have boreholes 14 on their periphery and perforating needles 15, which serve for representing letters and numbers, are inserted into these boreholes. Perforating needles 15 are accommodated in a guide box 16 and cooperate with a cutting plate 17 lying thereunder. The material or object to be perforated is guided between cutting plate 17 and guide box 16 into an input slot 18.

Figure 6:
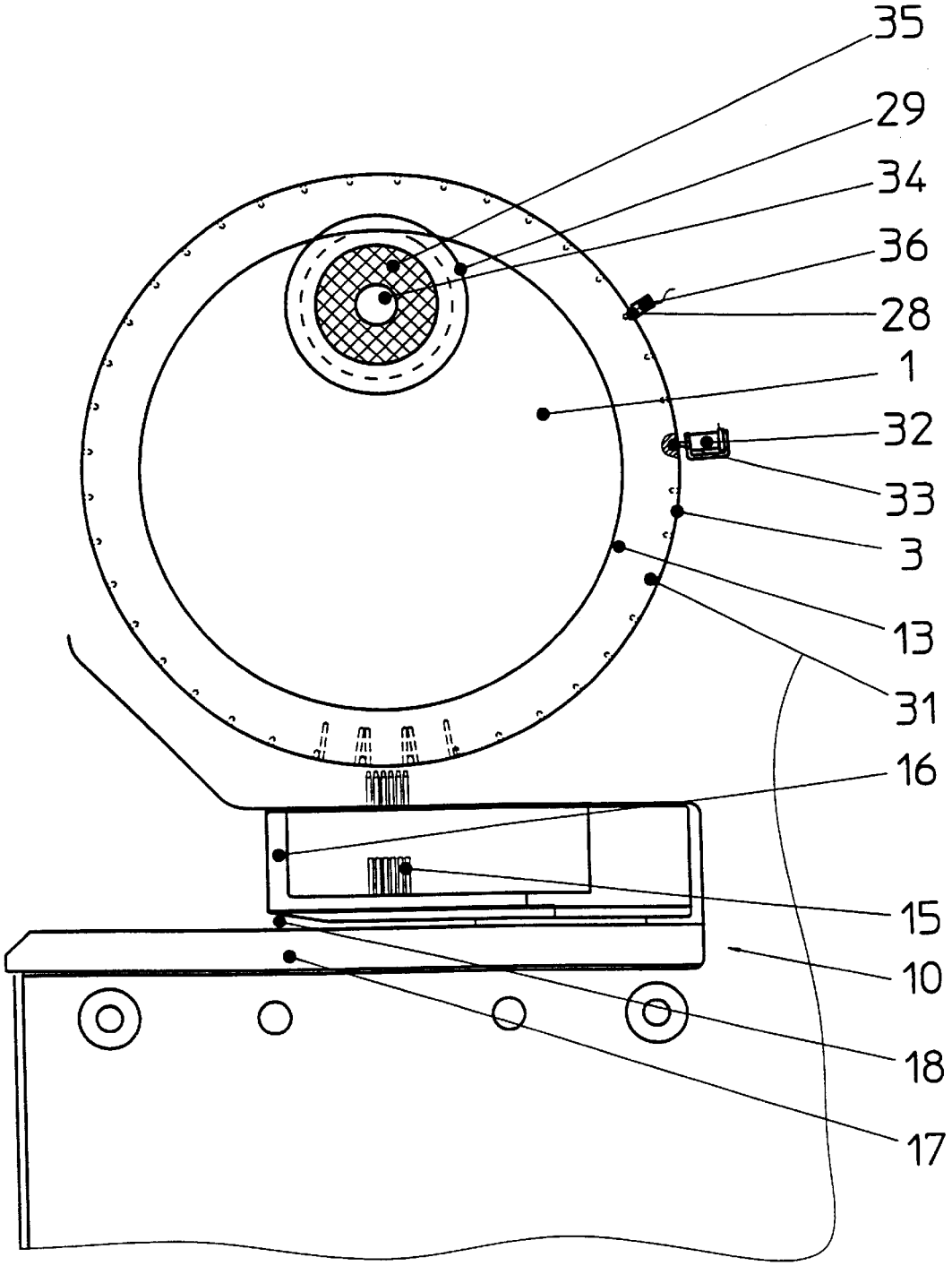
FIG. 6 is a schematic side view of another embodiment of a perforating device with a common drive motor for all perforating gears (section VI—VI of FIG. 7)
Figure 7:
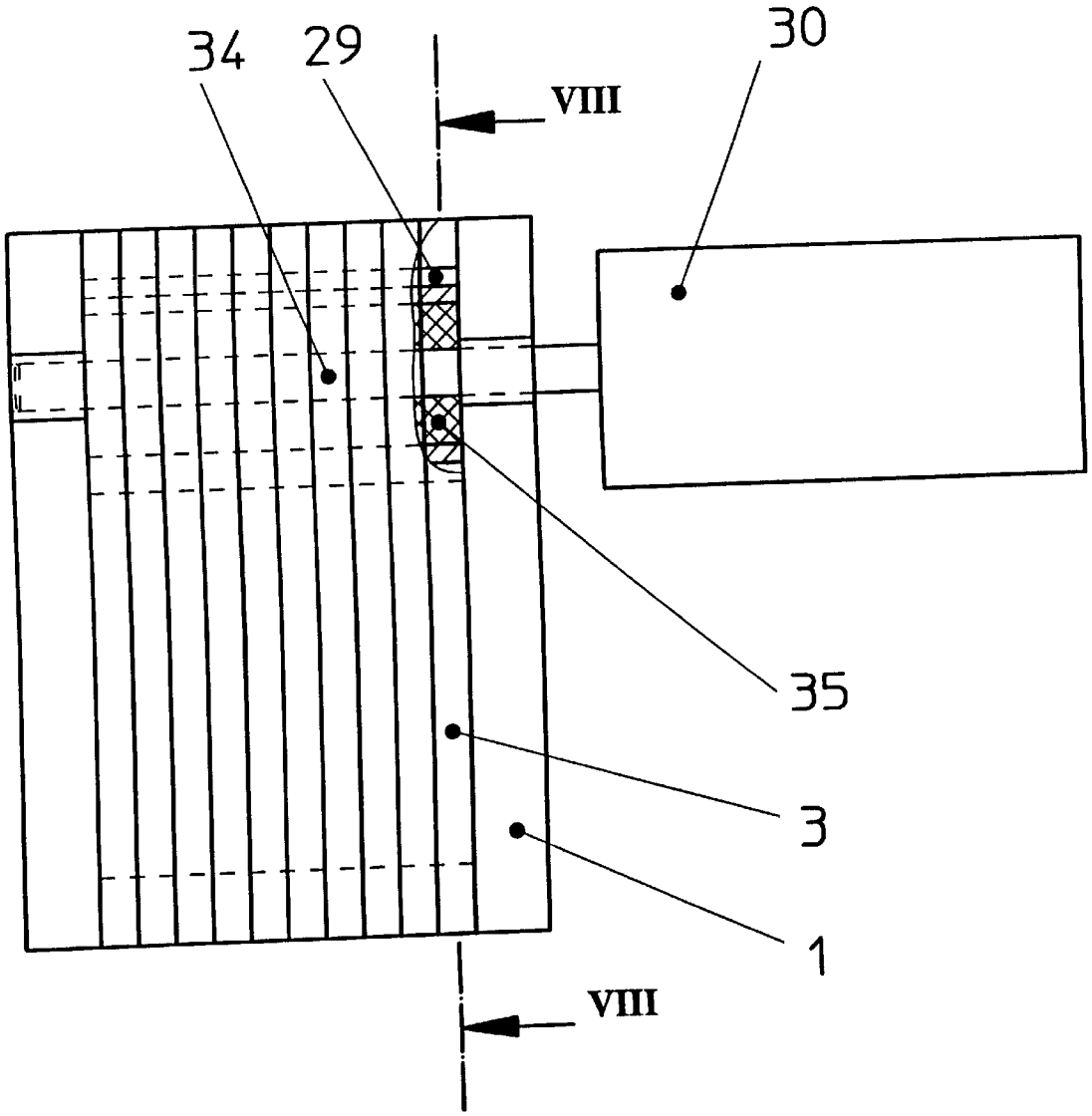
FIG. 7 is a schematic front view of the gearwork of the embodiment according to FIG. 6.

FIGS. 6 and 7 show one form of embodiment of the perforating device with a common outer-lying drive motor 30 for shifting all perforating gears 3.

According to the representation in FIG. 7, the perforating device is equipped with a simple electrical motor 30 as a drive. Drive 30 is joined each time with a toothed drive gear 29 of perforating gears 3 by means of an axle 34 and by means of sliding clutches 35 for each perforating gear 3, according to the representation in FIG. 6. Toothed drive gears 29 engage in inner toothed gearing 13 of perforating gears 3.

The setting of perforating gears 3 is undertaken as follows:

The rotating drive motor 30 moves all perforating gears 3 into the idle positions. During a rotation of perforating gears 3, a reference mark 28 passes a sensor 36. Reference mark 28 characterizes the null position of perforating gear 23. From this position, sensor 36 counts out the predetermined position of the respective perforating gear 3 to be adjusted and turns on an electromagnet 32 after reaching this position; this magnet undertakes the precise positioning of perforating gear 3 by engaging a catching pin 33 in a borehole 31 of perforating gear 3 and fixing perforating gear 3 in this position.

The decoupling of perforating gear 3 from drive 30 is effected by sliding clutch 35. The other perforating gears 3 rotate further until they have reached their preselected positions and are fixed in this position. After setting of all perforating gears 3, motor 30 is disconnected and perforation is accomplished.

Figure 3:
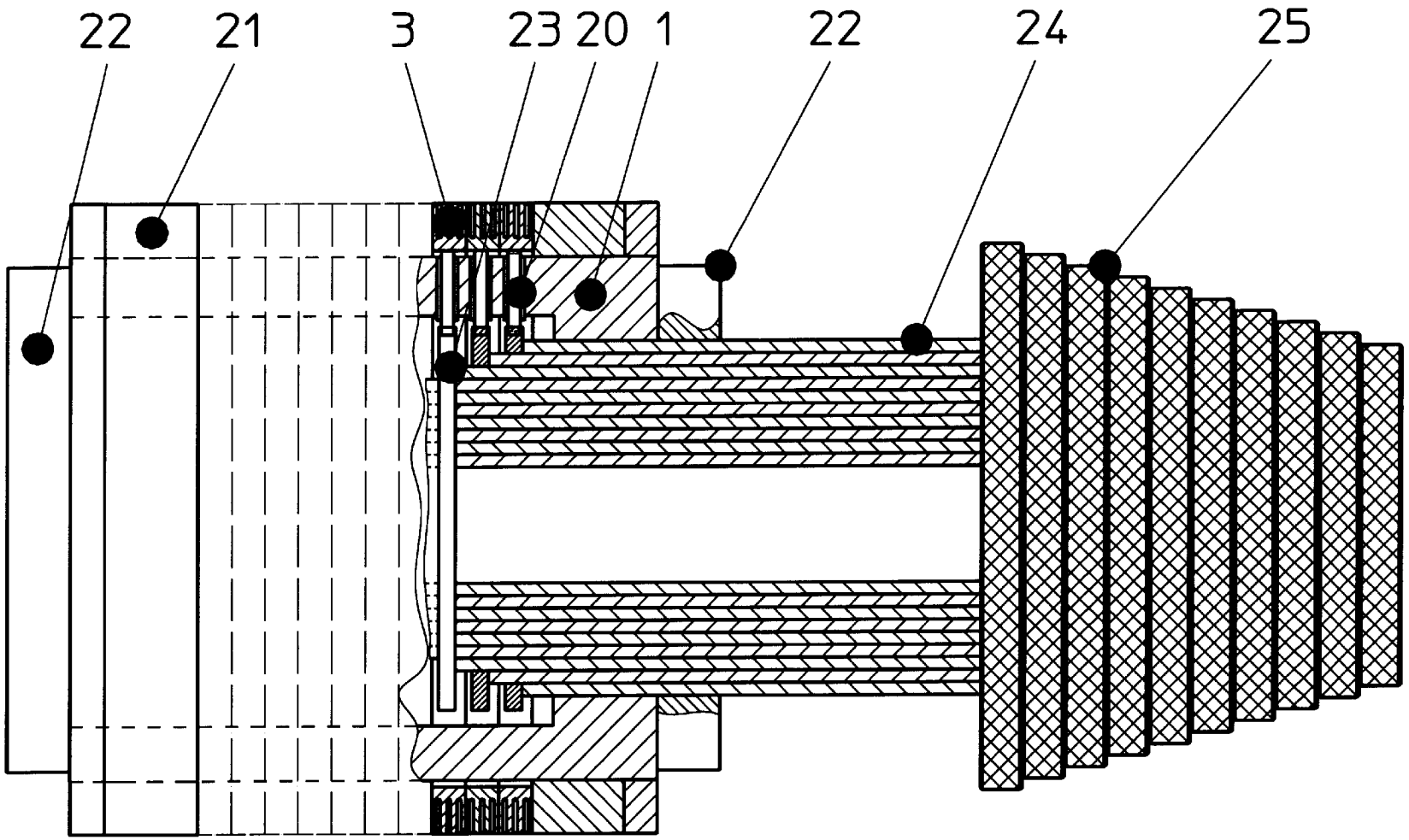
FIG. 3 is a schematic top view of another embodiment of a perforating device.

FIG. 3 shows another form of embodiment of the perforating device with the possibility of an electronic setting of the perforating gears by means of externally arranged drives.

According to the representation in FIG. 3, perforating gears 3 are introduced onto perforating gear uptake 1 and secured with a spacer ring 21, if uptake 1 is not completely filled.

Perforating gear uptake 1 is sealed on the front side by a guide plate 22.

Each perforating gear 3 is provided with an inner toothed gearing, and an intermediate toothed gear 20, which cooperates with a toothed drive gear 23, engages in this inner gearing. Toothed drive gear 23 is driven by means of a hollow axle 24 with one of the adjusting disks 25 and thus accomplishes the desired setting of the respective perforating gear 3.

Adjusting disks 25 are each activated by means of an electrical drive (not shown) or are moved with a central drive by means of, e.g., a magnetic coupling, and are equipped with an electronic control.

Figure 4:
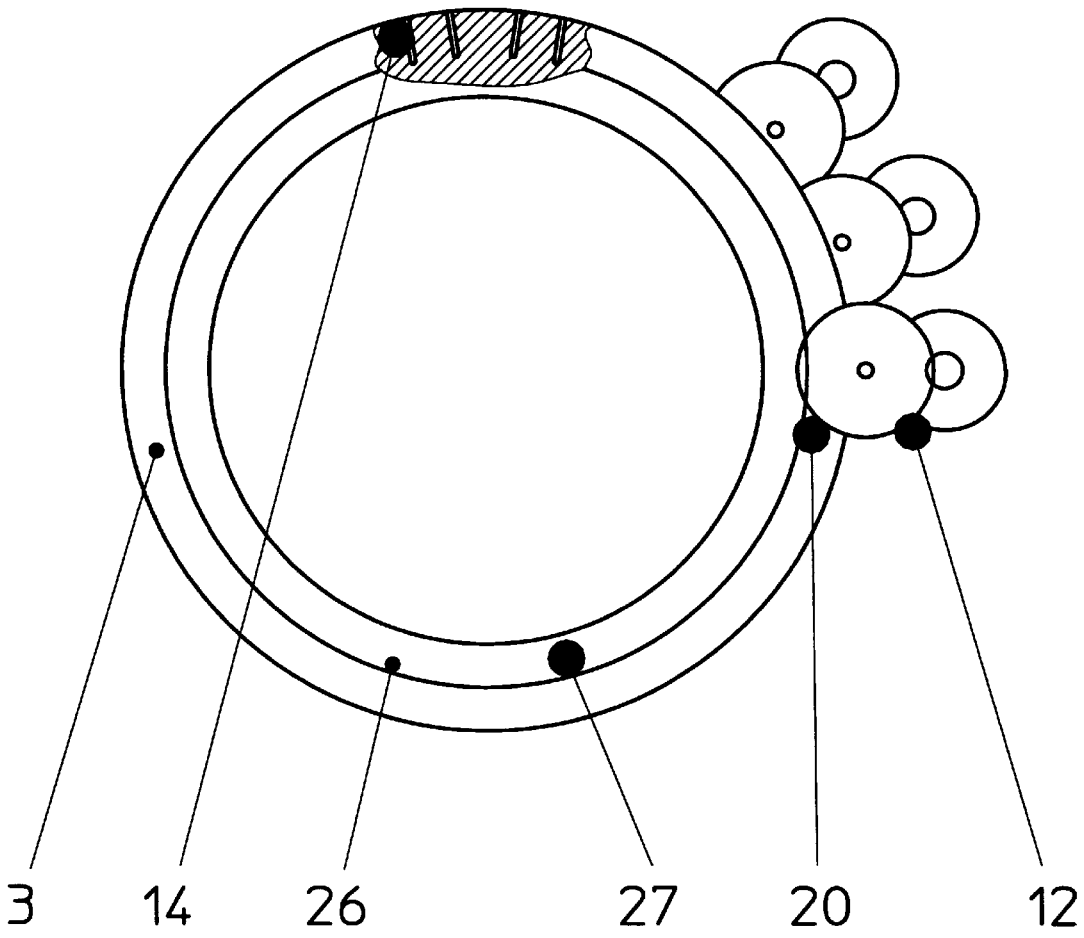
FIG. 4 is a schematic side view of a third embodiment of a perforating device.
Figure 5:
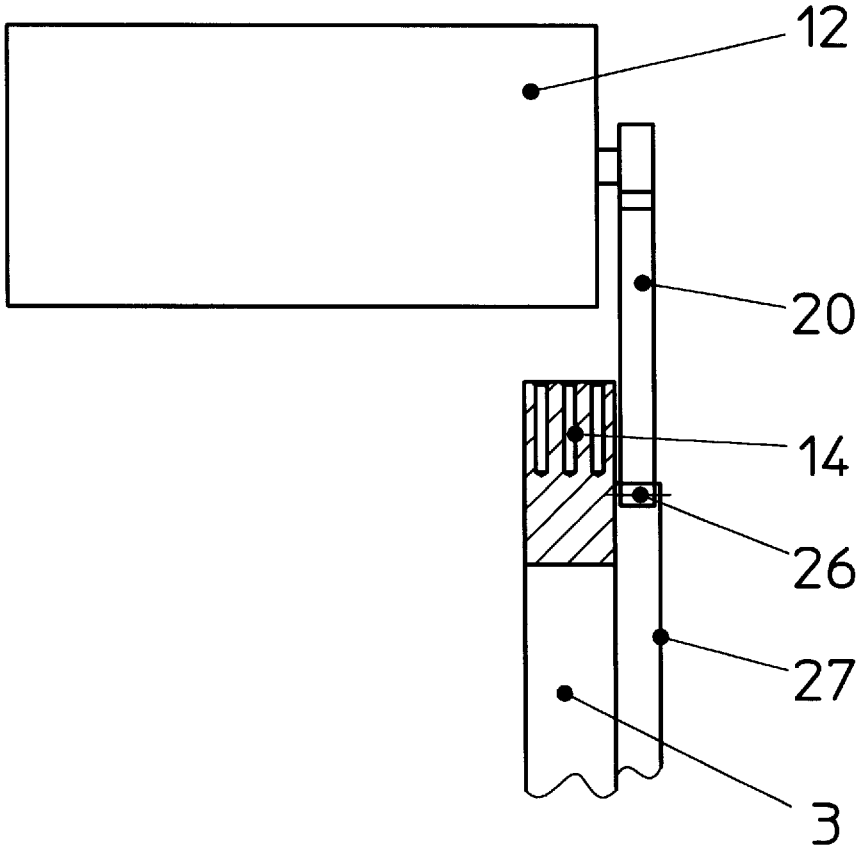
FIG. 5 is a schematic front view of the embodiment according to FIG. 4.

A third form of embodiment of a perforating device is shown in FIGS. 4 and 5.

In this form of embodiment, perforating gears 3 have an outer toothed gearing 26, which is introduced onto a plate 27 rigidly joined with the respective perforating gear 3. Outer toothed gearing 26 engages in a toothed gear 20, which is joined with motor 12 and makes possible the shifting of perforating gears 3. Adjusting motors 12 are arranged on the outside in this embodiment.

The control of the perforating device can be executed in an uncomplicated manner with any personal computer or with any data processing unit.

Also, a setting relative to a barcode reader or similar input device is possible.

The set combination of numbers or letters can be displayed on an alphanumeric display prior to each perforation and can be recorded on an optional journal printer with indication of date and time.

Since the perforating device has been adjusted automatically, perforation is triggered by a paper sensor, microswitch or foot switch. When disconnected, the last setting of the gearwork remains.

While specific embodiments of the invention have been shown and described in detail to illustrate the application of the principles of the invention, it will be understood that the invention may be embodied otherwise without departing from such principles.

What is claimed is:

1. A perforating device for representation of letters, symbols, and/or numbers, comprising:

an adjustable gearwork including perforating gears;

electronically controlled drives provided for the shifting said perforating gears of said adjustable gearwork; and a perforating gear uptake having a periphery with recesses for said perforating gears, said electronically controlled drives being introduced into said recesses, said recesses extending one of radially and axis-parallelly on said periphery of said perforating gear uptake or arranged axially displaced by at least one gear width (d) on said periphery of said perforating gear uptake.

2. The perforating device according to claim 1, wherein recesses on each half-periphery of said perforating gear uptake are arranged on alternating sides beginning from right and from left front sides of said perforating gear uptake.

3. The perforating device according to claim 1, wherein said drives each have a toothed drive gear, which is engaged with an inner toothed gearing of a respective one of said perforating gears after the positioning of the respective perforating gear.

4. The perforating device according to claim 1, further comprising an axle, a drive motor common to all of said perforating gears, a toothed drive gear for each perforating gear and a sliding clutch, wherein each of said perforating gears of said adjustable gearwork is joined with said axle of said drive motor, by means of a respective said toothed drive gear and by means of said sliding clutch and each of said perforating gears is adjusted to a predetermined working position therewith whereby said perforating gears of said adjustable gearwork provide perforations for the representation of letters, symbols, and/or numbers.

5. The perforating device according to claim 1, wherein said electronically controlled drives include a motor-shiftable adjusting disk, an intermediate gear, a toothed drive gear, an adjusting disk and a hollow axle, wherein said electronically controlled drives are provided for the shifting of said perforating gears, whereby said perforating gears are each set by means of said motor-shiftable adjusting disk, whereby an inner toothed gearing of a respective said perforating gear engages in teeth of an intermediate gear, which cooperates with said toothed drive gear and whereby a joining to said adjusting disk and to said drive is produced by means of a hollow axle whereby said perforating gears of said adjustable gearwork provide perforations for the representation of letters, symbols, and/or numbers.

6. The perforating device according to claim 1, further comprising an intermediate toothed gear, wherein said electronically controlled drives are provided for shifting perforating gears, whereby the electronically controlled drives are arranged on an outside and are joined by means of said toothed gear with said perforating gears provided with an outer toothed gearing whereby said perforating gears of said adjustable gearwork provide perforations for the representation of letters, symbols, and/or numbers.

7. The device according to claim 1, wherein said perforating gears of said adjustable gearwork are controlled by means of said electronically controlled drives for the shifting of said perforating gears and introducing said perforating gears into a programmed position for carrying out a perforation at a predetermined time point whereby said perforating gears of said adjustable gearwork provide perforations for the representation of letters, symbols, and/or numbers.

8. A process for perforating for representation of letters, symbols, and/or numbers, comprising the steps of:

providing an adjustable gearwork including perforating gears;

providing electronically controlled drives;

shifting said perforating gears of said adjustable gearwork with said drives and introducing said perforating gears into a programmed position for carrying out a perforation at a predetermined time point whereby said perforating gears of said adjustable gearwork provide perforations for the representation of letters, symbols, and/or numbers;

providing a perforating gear uptake having a periphery with recesses for said perforating gears; and introducing said electronically controlled drives into said recesses, said recesses extending one of radially and axis-parallelly on said periphery of said perforating gear uptake or arranged axially displaced by at least one gear width (d) on said periphery of said perforating gear uptake.

9. The process for perforating according to claim 8, wherein recesses on each half-periphery of said perforating gear uptake are arranged on alternating sides beginning from right and from left front sides of said perforating gear uptake.

10. The process for perforating according to claim 8, wherein said drives each have a toothed drive gear, which is engaged with an inner toothed gearing of a respective one of said perforating gears after the positioning of the respective perforating gear.

11. The process for perforating according to claim 8, further comprising providing an axle, a drive motor common to all of said perforating gears, a toothed drive gear for each perforating gear and a sliding clutch, wherein each of said perforating gears of said adjustable gearwork is joined with said axle of said drive motor, by means of a respective said toothed drive gear and by means of said sliding clutch and each of said perforating gears is adjusted to a predetermined working position therewith whereby said perforating gears of said adjustable gearwork provide perforations for the representation of letters, symbols, and/or numbers.

12. The process for perforating according to claim 8, wherein said electronically controlled drives include a motor-shiftable adjusting disk, an intermediate gear, a toothed drive gear, an adjusting disk and a hollow axle, wherein said electronically controlled drives are provided for the shifting of said perforating gears, whereby said perforating gears are each set by means of said motor-shiftable adjusting disk, whereby an inner toothed gearing of a respective said perforating gear engages in teeth of an intermediate gear, which cooperates with said toothed drive gear and whereby a joining to said adjusting disk and to said drive is produced by means of a hollow axle whereby said perforating gears of said adjustable gearwork provide perforations for the representation of letters, symbols, and/or numbers.

13. The process for perforating according to claim 8, further comprising an intermediate toothed gear, wherein said electronically controlled drives are provided for shifting perforating gears, whereby the electronically controlled drives are arranged on an outside and are joined by means of said toothed gear with said perforating gears provided with an outer toothed gearing whereby said perforating gears of said adjustable gearwork provide perforations for the representation of letters, symbols, and/or numbers.

* * * * *